US010676984B1

(12) United States Patent
Crittenden

(10) Patent No.: US 10,676,984 B1
(45) Date of Patent: Jun. 9, 2020

(54) HOLLOW CORE DOOR FOR PEVENTING PRESSURE BUILD UPHAVING A DIVIDED NON-LINEAR AIR FLOWTHROUGH THE DOOR

(71) Applicant: Jerry G. Crittenden, Phoenix, AZ (US)

(72) Inventor: Jerry G. Crittenden, Phoenix, AZ (US)

( * ) Notice: Subject to any disclaimer, the term of this patent is extended or adjusted under 35 U.S.C. 154(b) by 0 days.

(21) Appl. No.: 16/350,195

(22) Filed: Oct. 10, 2018

Related U.S. Application Data

(63) Continuation of application No. 15/732,347, filed on Oct. 27, 2017, now Pat. No. 10,301,869, which is a continuation-in-part of application No. 15/330,870, filed on Nov. 9, 2016, now Pat. No. 10,156,091, and a continuation-in-part of application No. 15/330,471, filed on Sep. 24, 2016, now Pat. No. 9,803,417, and a continuation-in-part of application No. 14/999,148, (Continued)

(51) Int. Cl.

| | |
|---|---|
| ***E06B 7/10*** | (2006.01) |
| ***E06B 3/70*** | (2006.01) |
| ***E06B 3/74*** | (2006.01) |
| ***E06B 7/02*** | (2006.01) |
| *F24F 13/18* | (2006.01) |

(52) U.S. Cl.

CPC ..... *E06B 7/10* (2013.01); *E06B 3/7015* (2013.01); *E06B 3/74* (2013.01); *E06B 2003/7049* (2013.01); *E06B 2003/7094* (2013.01); *E06B 2007/026* (2013.01); *F24F 13/18* (2013.01)

(58) Field of Classification Search

CPC . E06B 7/10; E06B 3/74; E06B 3/7015; E06B 2003/7049; E06B 2007/026; E06B 2003/7094; F24F 13/18

USPC ..... 454/195; 52/455

See application file for complete search history.

(56) References Cited

U.S. PATENT DOCUMENTS 1,701,992 A * 2/1929 Wills ..... E06B 7/02 454/195
1,701,993 A * 2/1929 Wills ..... E06B 7/02 454/195

(Continued)

FOREIGN PATENT DOCUMENTS

CN 203783390 U * 8/2014
JP 200213249 A * 8/2000

(Continued)

*Primary Examiner* — Edelmira Bosques
*Assistant Examiner* — Frances F. Hamilton
(74) *Attorney, Agent, or Firm* — H. Gordon Shields

(57) ABSTRACT

A hollow core door for a room, the door includes a stile and rail frame, an inside skin having a plurality of holes extending therethrough, an outside skin having a plurality of holes extending therethrough, both skins secured to the frame. The door includes a-panel disposed between the inside and outside skins, the panel having a surface area greater than an area of the pluralities of holes, and having openings disposed laterally of the pluralities of holes. The panel includes a slider panel having a plurality of slider panel openings, the slider panel slidable to alternately allow or block a flow of air. The pluralities of holes are located whereby air flows inwardly through the plurality of holes in the inside skin, divides, flows about the panel and through its openings, and outwardly through the plurality of holes in the outside skin in a non-linear manner.

17 Claims, 12 Drawing Sheets

Related U.S. Application Data filed on Apr. 1, 2016, now Pat. No. 9,493,980, and a continuation-in-part of application No. 14/756,033, filed on Jul. 23, 2015, and a continuation-in-part of application No. 14/756,017, filed on Jul. 21, 2015, now Pat. No. 9,719,291, and a continuation-in-part of application No. 14/120,870, filed on Jul. 7, 2014, now Pat. No. 9,109,389, and a continuation-in-part of application No. 12/927,766, filed on Nov. 23, 2010, now Pat. No. 9,085,933.

(56) References Cited

U.S. PATENT DOCUMENTS 2,308,262 A * 1/1943 Forrest ..... F24F 13/18 49/38
2,668,788 A * 2/1954 Waldherr ..... B27D 1/06 156/256
2,771,021 A * 11/1956 Buckley ..... E06B 5/00 454/195
3,094,058 A * 6/1963 O'Brien, Jr. ..... E06B 7/10 454/195
3,295,273 A * 1/1967 Wehe, Jr. ..... E06B 3/822 52/145
3,789,747 A * 2/1974 Wasserman ..... F24F 7/08 454/186
4,019,429 A * 4/1977 Sado ..... E06B 7/02 454/276
4,027,581 A * 6/1977 Yamamoto ..... E06B 7/02 454/212
4,393,860 A * 7/1983 French ..... F24S 20/66 126/631
4,706,422 A * 11/1987 Ashton ..... E04B 2/7411 181/284
5,120,273 A * 6/1992 Lin ..... E06B 7/02 454/195
5,230,738 A * 7/1993 Wheeler ..... E04G 21/30 118/504
5,369,869 A * 12/1994 Bies ..... E06B 3/7001 156/79
5,584,760 A * 12/1996 Green ..... E06B 7/10 454/195
5,901,768 A * 5/1999 Herbst ..... E06B 5/003 160/90
5,976,009 A * 11/1999 Achen ..... E06B 7/082 454/195
8,615,945 B2 * 12/2013 Walker ..... E04C 2/34 428/105
9,493,949 B2 * 11/2016 Yau ..... E04C 2/523
9,534,385 B2 * 1/2017 Burr ..... E04C 2/523
2006/0270334 A1 * 11/2006 Kim ..... E06B 7/10 454/200
2015/0108889 A1 * 4/2015 Bavuso ..... E06B 5/006 312/294
2016/0097234 A1 * 4/2016 Fagan ..... E06B 3/78 52/204.1

FOREIGN PATENT DOCUMENTS

JP 2002070446 A * 3/2002
JP 2012026236 A * 2/2012
JP 6131679 B2 * 5/2017 ..... E06B 7/02

* cited by examiner

HOLLOW CORE DOOR FOR PEVENTING PRESSURE BUILD UPHAVING A DIVIDED NON-LINEAR AIR FLOWTHROUGH THE DOOR

BACKGROUND OF THE INVENTION

Field of the Invention

This invention pertains to a hollow core door having a stile and rail frame and inside and outside skins and which have a plurality of perforations on portions of the inside and outside skins, and a panel spaced apart between and adjacent to the perforations and about which air flows. The it flows through the perforations in the inside skin, and about, or around, the panel, an through the perforations in the outside skin in a non-linear manner to prevent the build up of pressure in a closed room in which the door is secured.

Description of the Prior Art

Hollow core doors have been made for many years for inside doors. The hollow core doors are less expensive than solid core doors, are easier to manufacture, and they are generally rigid and hence resist warping and twisting. Such hollow core doors make up the largest share of inside doors where strength and security are not required.

A hollow core door includes a conventional perimeter frame having a pair of vertically extending stiles and a pair of horizontally extending rails. The perimeter frame is typically covered with plywood or other appropriate panels, or skins, as they are known in the hollow core door art, secured to the perimeter frame. There are generally also inside frame elements, typically wood strips extending horizontally between vertical frame members or in an "x" or other configuration within the perimeter frame for reinforcing the skins.

With the advent of cheaper materials, such as hardboard and medium density fiberboard (mdf) to replace the plywood, the construction of doors became less expensive, using the cheaper materials, than the manufacture of doors using the more expensive plywood panels or skins. However, the use of hardboard and mdf also requires a binder, and the most commonly used binder is a urea formaldehyde resin or compound. In other words, the substances out of which panels for hollow core doors are made inherently include, under contemporary manufacturing processes, at least a single noxious material.

The use of urea formaldehyde contributes to what is sometimes referred to as "Sick Building Syndrome." This syndrome is caused by the gas emissions from the formaldehyde and from other chemicals used in the new door products and from other products in the home that also use formaldehyde resin or binder, such as furniture, kitchen cabinets, wood flooring, counter tops, wallpaper, carpet, and even paint.

There may also be other factors contributing to the Sick Building Syndrome, such as poor ventilation, combustion gases, fumes from attached garages, high auto traffic, tobacco smoke, and various volatile organic chemicals or VOCs. However, formaldehyde compounds or products probably contribute most to the Sick Building Syndrome and to the discomfort of people in the building or structure.

One solution to the syndrome is to provide scrubbers in the inside of the hollow core door to remove noxious materials from air flow through the door.

Hollow core doors also have an advantage in that the hollow core is ideal for including pressure equalization elements to prevent air pressure from building up within a closed room. Air pressure building up in a room interferes with the proper circulation of heated or cooled air in a forced air system.

The several embodiments of hollow core doors and a stile and rail door of this series of doors as set forth in the "CROSS REFERENCE . . . paragraph overcome the problem of preventing pressure build up in a closed room and at the same time provide some privacy benefits relative to light, sight, and sound. Those doors will be briefly discussed below.

Moreover, the air scrubbing and pressure build up prevention doors may be combined with information sensing elements and actuators to provide doors that perform a scrubbing function and a pressure build up prevention function and other desired functions, such as adjusting the amount of air flowing through a door in response to sensed information. These doors are sometimes referred to herein and in the various parent applications and patents as "smart doors."

The light, sight, and sound benefits are primarily provided by non-linear air flow through the various doors. The term "non-linear" is defined as providing at least five changes in the direction of the air flow through a door.

SUMMARY

The invention described and claimed herein comprises a hollow core door with perforations extending through the outer skins and a fixed panel disposed between the perforations and about which air flow is divided as the air flows through the door in a non-linear manner.

The hollow core door of the present invention has a divided air flow through the door for preventing the build up of pressure in a room in which the door is secured. The perforated openings or holes in the skins extend in rows and columns of a predetermined width and height on the inside and outside skins. The perforated areas on the skins may be located as desired in a particular portion of a door and still provide the required total area for the flow of air through the door to prevent the build up of pressure in a closed room.

The air flow is through the holes and about the fixed panel between the skins causes the air flow to divide and flow in a non-linear manner through the door. The hole or perforation rows may be varied in size to provide the required air flow through a door. The size of the perforations or holes and their locations may also be varied as desired for both air flow and esthetic considerations.

The air flow through the door has at least five changes of direction to provide the non-linear flow of air through the door to prevent a build up of pressure in a room to which a door is secured. The total areas of the perforations in the inside skin and in the outside skin are greater than the area of the air inflow to the room so that there is no build up of pressure in the room.

Among the objects of the present invention are the following:

To provide a new and useful hollow core door;

To provide a new and useful hollow core door having skins secured to a stile and rail frame;

To provide a new and useful door having air flow through the door of a predetermined amount equal to or greater than the air flow into the room to prevent the build up of pressure in the room;

To provide a new and useful hollow core door having inside and outside skins with perforations on the skins;

To provide a new and useful hollow core door having a panel disposed between the perforations in the inside and outside skins and about which air flows;

To provide a new and useful hollow core door having a panel with openings through which air flows;

To provide a new and useful hollow core door having holes extending through inside and outside skins and a center panel disposed between the skins and adjacent to the holes in the skins;

To provide a new and useful hollow core door having holes in the inside and outside skins and a panel having an area greater than the areas of the holes in the inside and outside skins to cause the air flow through the holes in the inside skin to divide and flow about the panel and then flow through the perforations in the outside skin in a non-linear manner;

To provide a new and useful hollow core door having a center panel with openings in the center panel located outwardly from holes in an inside skin and outwardly from holes in the outside skin whereby air flows through the holes in the inside skins and through the openings in the center panel and through the holes in the outside skin in a non-linear manner;

To provide a new and useful hollow core door having a slider panel disposed adjacent to the center panel or controlling the air flow through the openings in the center panel;

To provide a new and useful hollow core door having a slider panel disposed adjacent to a center panel and slots extending through the top rail for receiving masking material to protect a slider panel from paint;

To provide a new and useful method of making a hollow core door;

To provide a new and useful door combining an air flow through the door with material in the door over which the air flows for removing noxious materials from the air flow and for preventing a pressure build up in a room by flowing air non-linearly through the door to a return air space;

To provide new and useful apparatus for preventing a build up of pressure in a closed room having a forced air system; and To provide new and useful divided air flow apparatus for preventing a build up of pressure in a closed room having a forced air system;

DESCRIPTION OF THE PREFERRED EMBODIMENT

In the following discussion of FIGS. 1-19, reference will be made to the patents and applications as set forth above in the "CROSS REFERENCE . . . " paragraph. The reference numbers for the various doors are from the original patents and applications, but the figure numbers used herein are for convenience in the present invention. The figure numbers from the original patents and applications and patents are appropriately noted. The following discussion relative to the doors follows sequentially according to their original application numbering.

It will be noted that in the following discussion for the hollow core doors and the stile and rail door, the terms "inside" and "outside" refer to the room in which the doors are installed. "Inside" refers to the side of the door on the inside of the rooms and "outside" refers to the side of the door which faces outwardly from the room and is in contact with the return space, as for example, the space 434 in FIG. 3

Figure 1:
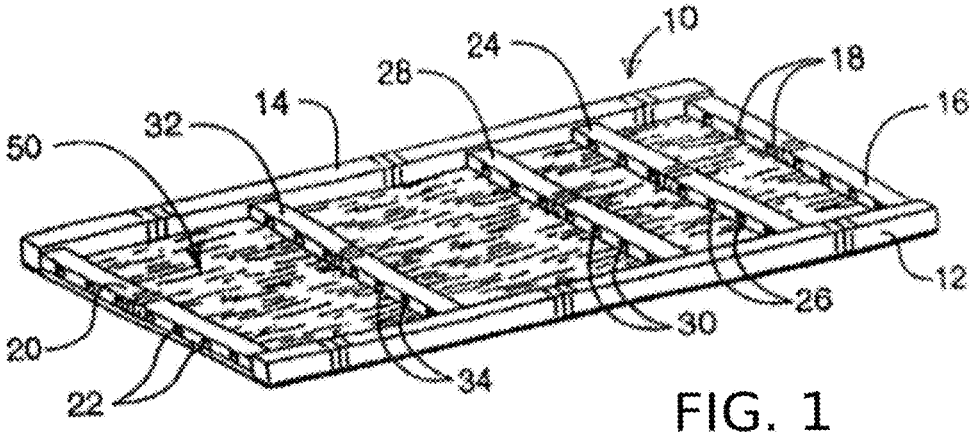
FIG. 1 is a perspective view of a hollow core door 10.
Figure 2:
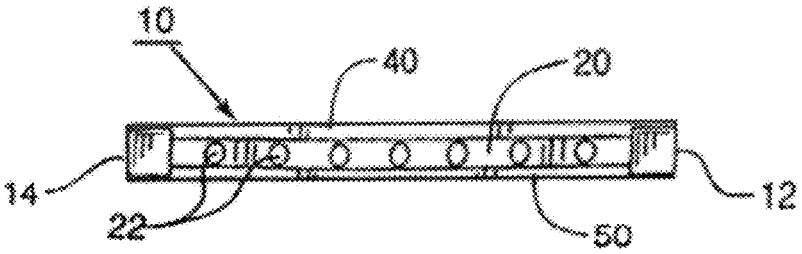
FIG. 2 is an end view of the door 10 of FIG. 1.

FIGS. 1 and 2 illustrate the construction of a hollow core door 10 from the '993 patent. (FIGS. 1 and 2 herein were original FIGS. 5 and 6 in the '993 patent) FIG. 1 is a perspective view of the hollow core frame and a bottom skin 50. FIG. 2 is a bottom end view of the door 10. The frame includes a pair of stiles 12 and 14 and a pair of rails 16 and 20. In FIG. 2, skins 40 and 50 are shown secured to the frame of the door.

Three cross elements 24, 28, and 32 are shown extending between the stiles 12 and 14 to provide support for the skins 40 and 50. A series of holes extend through the rails and the center support elements for the flow of air vertically through the door. A coating on the skin 50 provides a scrubbing action to remove noxious materials from the flow of air.

Except for the door 10 of the '933 patent, all of the doors pertain to the prevention of pressure building up in a room by passing air through the door in a non-linear manner. The air flow through the door is correlated with the air flow into the room to prevent the build up of pressure in the room to meet the DOE's Zero Energy Ready Home Program. The Program generally considers that the pressure in a closed room should be less than three pascals, or about 0.012 inches of a water column. For larger rooms, the recommended pressure is equal to or less than five pascals.

The '389 patent discloses four embodiments of hollow core doors 410, 460, 520, and 620, which prevent the build up of pressure in closed rooms by air flow through the doors. The '389 patent is the first patent in a continuing series of doors for preventing the build up of pressure in a closed room by providing non-linear air flow through the doors. Non-linear air flow provides at least five changes of direction in the air flow.

Figure 3:
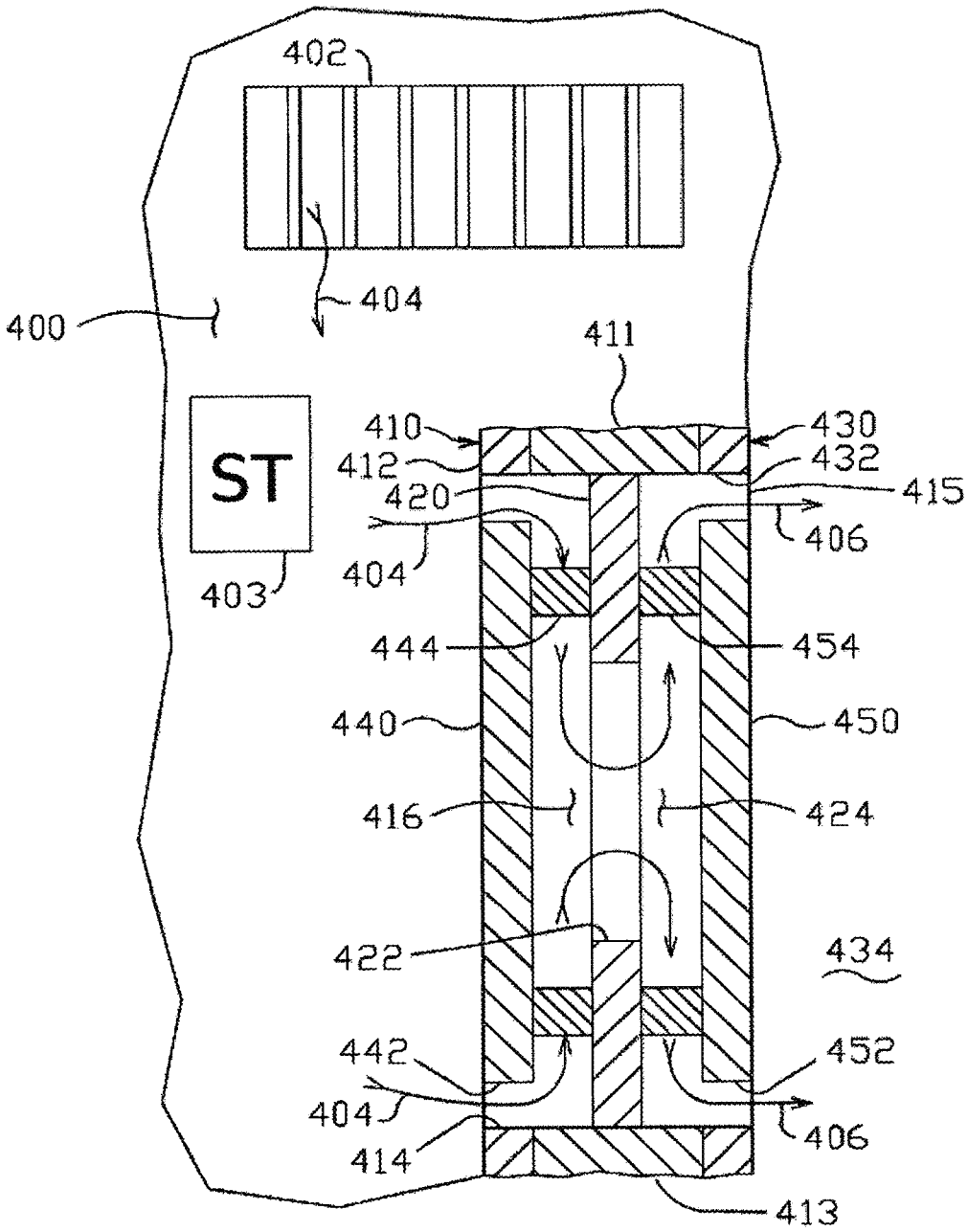
FIG. 3 is a schematic view of a portion of a room 400 and a view in partial section of a portion of a door 410.

FIG. 3 (original FIG. 14) is a view in partial section of a portion of a door 410, shown schematically in a room 400. A register 402 provides a flow of air 404 into the room 400. The non-linear path of the air flow 404 through the door 410 is shown by arrows.

Figure 4:
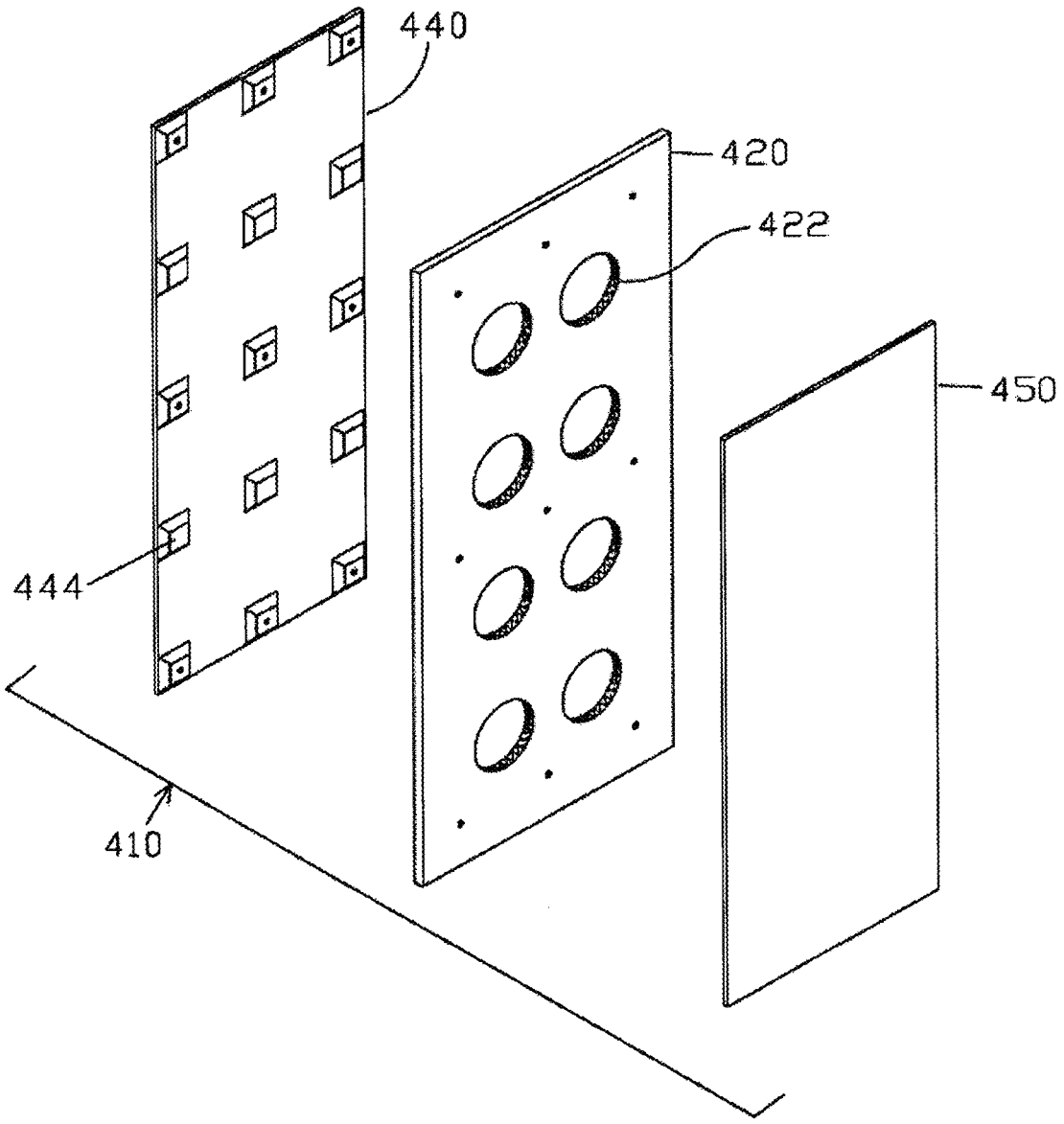
FIG. 4 is an exploded view of the elements of the door shown in FIG. 3.

FIG. 4 (original FIG. 15) is an exploded perspective view of a portion of the door 410 of FIG. 3. For the following discussion, reference may be made to FIGS. 3 and 4, and also to the '389 patent.

The door 410 includes an inside door panel or skin 412 comparable to the panel or skin 50 as may be best understood from FIGS. 1-2. The panel or skin 412 is appropriately secured to a top rail 411 and to a horizontal bracing element 413. The top rail 411 is comparable to the top rail 16 of FIG. 1, and the element 413 is broadly comparable to the bracing element 24 of FIG. 5. A single stile 415 is shown in FIG. 3.

The construction of the door 410 is typical of hollow core doors other than the air flow refinements of the air flow elements. Extending through the inside door skin 412 is an opening 414. The opening 414 may be rectangular, or circular, etc. In the opening 414 is an inside panel 440. The configuration of the panel 440 is generally the same as that of the opening 414. The air flow 404 from the register 402 flows through the opening 414 and about the inner panel 440 and into an intake air space 416.

The door 410 also includes an outside door panel of skin 430, comparable to the skin 40, as may be understood from FIGS. 1 and 2. The door panel or skin (generally "skin" or "skins" hereafter) 430 includes an opening 432 which is generally parallel to the opening 414 and is substantially the same size as the opening 414. Disposed in the opening 432 is an outside panel 450. The outside panel 450 is generally parallel to the inside panel 440 and is substantially the same size.

Between the door skins 412 and 430 is a center panel 420. The center panel 420 includes a plurality of openings 422. Adjacent to the openings 422 on the opposite side of the center panel 420 and between the center panel 420 and the outer panel 440 is an outflow space 424. The outflow space 424 is generally parallel to the intake space 416 and is substantially the same size.

The inner panel 440 includes an outer periphery or rim 442, and the outer panel 540 includes an outer periphery or rim 452. Between the panel 440 and the center panel 420 is a plurality of spacers 444. Between the outer panel 450 and the center panel 420 is a plurality of spacers 454. The spacers 444 and 454 secure the panels 440 and 450, respectively, to opposite sides of the center panel 420, and appropriately space the center panel 420 from the inner and outer panels to define the size of the intake space 416 and the size of the outflow space 424. The spaces 416 and 424 have the same area.

It will be noted that the spacers 444 and 454 are shown in FIG. 4 as being truncated pyramidal in configuration. The configuration of the spacers is immaterial; they may be of any desired or convenient configuration.

It will be noted that there are two peripheral spaces shown in FIG. 3 There is a first or inside peripheral space between the opening 414 and the rim or outer periphery 442 of the inside panel 440, and through which the air flow 404 flows into the space 416. There is a second, or outer peripheral space between the opening 432 and the rim or outer periphery 452 of the outside panel 450 through which the air flow 406 flows or passes to the return air space 434.

There is a smooth flow of air 404 from the register 402 through the peripheral space about the rim 442 of the inside panel 440 within the opening 414 into the intake space 416. The air then flows through the opening 422 in the center wall 420 to the outflow space 424 and outwardly through the peripheral space about the rim 452 of the outside panel 450 in the opening 452, and becomes an air outflow 406 to the return air space 434 outside the room 400, thus preventing the build up of air pressure in the room 400.

The areas through which the air flows must provide an area proportional to the CFM of the inflow of air through the register 402. There is a relationship between the CFM of the inflow 404 and the square inches of the areas through which the air flows. For example, for a 90 CFM inflow 404, there should be an area of about 90 square inches through which the air flows through the peripheral space between the opening 416 and the rim 442 into the space 416, and there should be at least the same 90 square inches in the openings 422 for the flow of air from the space 416 into the space 424. There also should be the same 90 square inches for the air flow 406 through the peripheral space between the opening 432 and the rim 542.

The peripheral spaces of the inside panel 440 and the outside panel 450 and the size or area of the openings 422 are appropriately dimensioned to provide at least the same or greater area than the area of the register through which the air 404 flows. The air flow 404 thus has no constraints to flowing non-linearly through the door 410 and outwardly from the room 400 into an air return space 434 outside the room 400.

Figure 5:
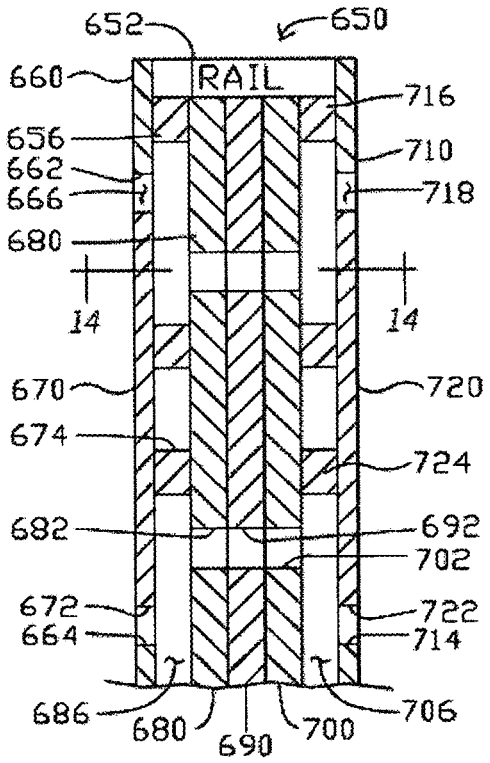
FIG. 5 is a view in partial section of a portion of a door 650.
Figure 6:
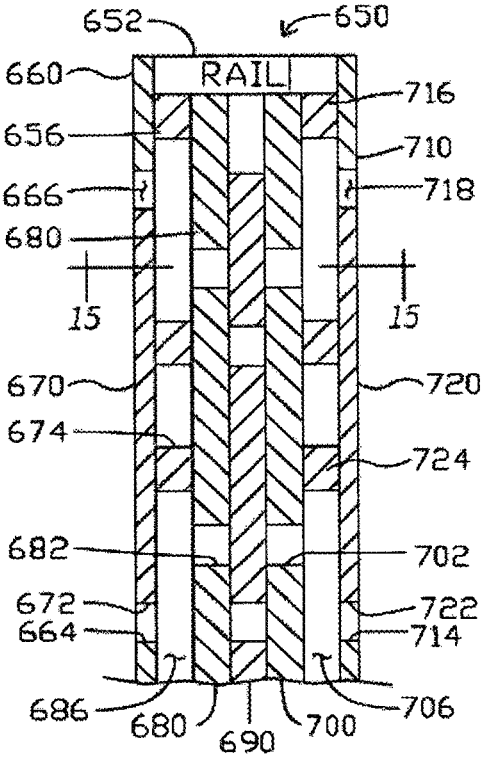
FIG. 6 is a view in partial section sequentially following FIG. 5.
Figure 24:
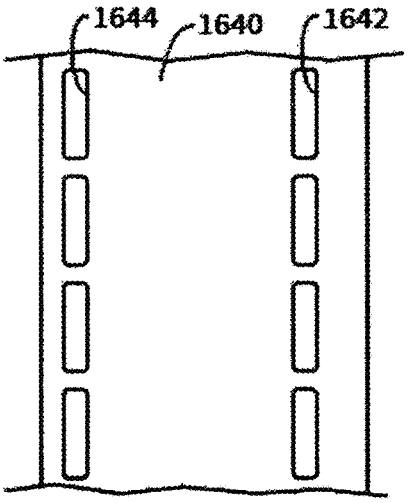
FIGS. 24 and 25 are fragmentary views of elements of the door of FIG. 23.
Figure 25:
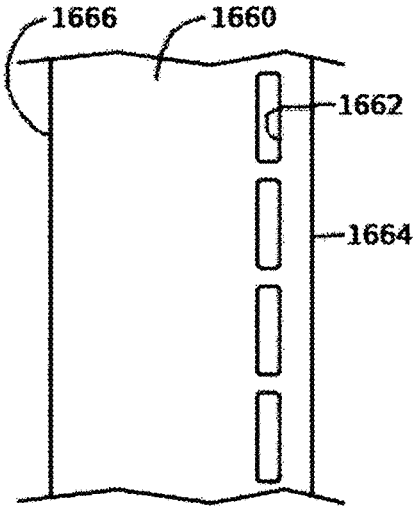

The '291 patent discloses a hollow core door 650 with a pair of fixed panels and a sliding panel between the fixed panels to control the flow of air through the door. FIGS. 5 and 6 are fragmentary views of the door 650. FIG. 5, original FIG. 24, and FIG. 6, original FIG. 25, are fragmentary views in partial section, sequentially illustrating the air flow through fixed panels 680 and 700 and through a sliding panel 690. FIGS. 5 and 6 herein have been slightly modified from the original drawing Figs. In the '291 patent.

For the following discussion, reference may be made to FIGS. 5 and 6 and to the '291 patent.

The door 650 includes an inside skin 660 and an outside skin 710. The skins 660 and 710 are shown secured to a top rail 652. The inside skin includes an opening 662 which has an inner periphery 664. The outside skin 710 includes an opening which has an inner periphery 714.

An inside panel 670 is disposed in the opening 662, and the panel 670 has an outer periphery 672. An outside panel 720 is disposed in the opening in the outside skin 710, and the outside panel 720 has an outer periphery 722. Peripheral space 666 is defined between the inner periphery 664 and the outer periphery 672. A peripheral space 718 is defined between the inner periphery 714 and the outer periphery 722. The peripheral spaces 666 and 718 are substantially equal, and are correlated for air flow in accordance with the air flow into the room, such as the room 400 for the air flow 402, of FIG. 3, as discussed above.

The fixed panel 680 includes a plurality of openings 682, and the fixed panel 700 includes a plurality of openings 702. The sliding panel 690 includes a plurality of openings 692. The openings 682, 702, and 692 are substantially equal.

When the openings 682, 692, an 702 are aligned, as shown in FIG. 5, air will flow through the peripheral space 666, through the aligned holes, and outwardly through the door 650 through the peripheral space 718 in a non-linear manner, as with the door 410.

When the sliding panel is moved out of alignment with the respective holes, as shown in FIG. 6, no air will flow through the door. Control of the sliding panel illustrated and discussed in detail in the '291 patent.

Figure 7:
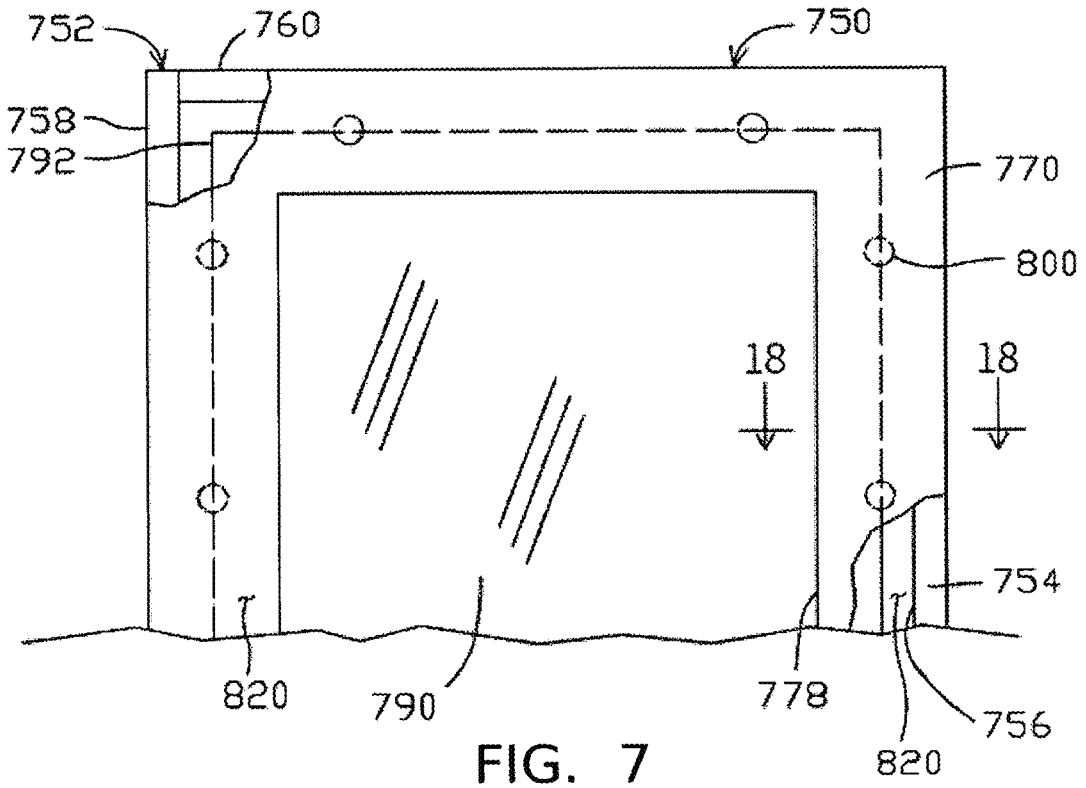
FIG. 7 is plan view, partially broken away, of a portion of a door 750.
Figure 8:
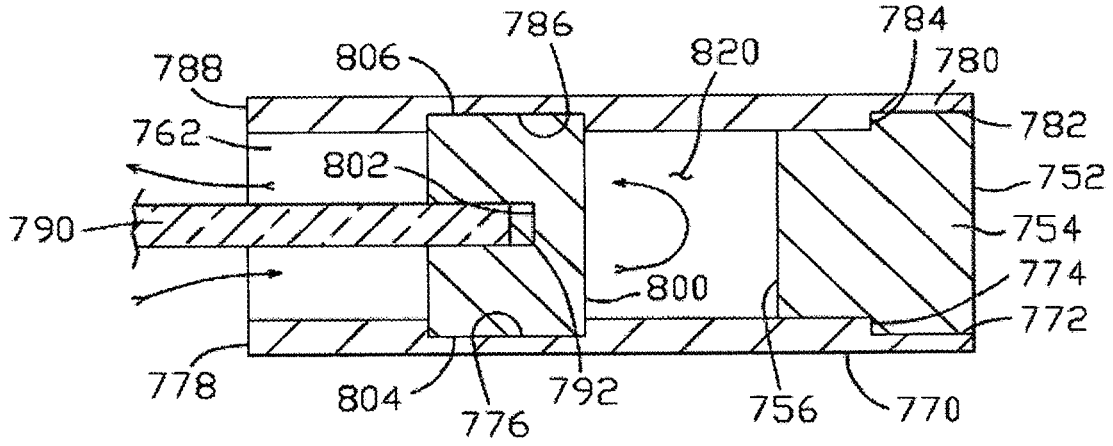
FIG. 8 is a view in partial section taken along line 8-8 of FIG. 7.

The '033 application discloses a hollow core door 750 with openings in inside and outside skins through which air flows about a fixed center panel. FIG. 7 (original FIG. 29) is a fragmentary front view of a portion of the door 750, with portions broken away to show construction features of the door. FIG. 8 (original FIG. 30) is a view in partial section taken generally along line 8-8 of FIG. 7.

Air flows about the fixed center panel to prevent the build up of pressure in a closed room. The skins have openings offset from the outer periphery of the center panel to provide non-linear air flow through the door. For the following discussion reference will be made to both FIGS. 7 and 8.

The door 750 is a typical hollow core door, with a frame 752 which includes a pair of stiles 756 and 758, and a pair of rails, of which a top rail 760 is shown in FIG. 7. An inside skin 770 and an outside skin 788 are secured to the frame 752. The inside skin 770 includes an opening 778, and the outside skin includes an opening 788.

The inside skin 770 includes a rabbet 782, and a shoulder 784. The outside skin 780 includes a rabbet 782 and a shoulder 784. The stile 754 extends into the rabbets 772 and 782 and against the shoulders 774 and 784.

A center panel 790 is supported between the inside and outside skins by a plurality of spaced apart support blocks 800. The support blocks 800 are disposed in recesses 776 and 786, respectively, in the inside skin 770 and in the outside skin 780. The center panel 790 has an outer periphery 792. The support blocks 800 include recesses 802 which receive the outer periphery 792 of the center panel 790. The center panel 790 is thus held at a predetermined distance or spacing between the skins 770 ands 780.

The air flow through the door 750 is illustrated in FIG. 8 by arrows. The air flows into the hollow core of the door 750 through the opening 778 in the inside skin 770, and into a chamber 820. The chamber 820 is defined between the skins 770 and 780 and an end 756 of the stile 754. The air flows about the center panel 790 and outwardly through the opening 788 in the outside skin 780. The air flow is non-linear with at least five changes of direction in its path into, through, and out of, the door 750, as with the other doors discussed above and below.

The '980 patent discloses a solid core door 830 with hollow stiles and rails through which air flows to prevent the build up of pressure in a room, such as the room 400 of FIG. 3, above, to which the door 830 is secured. Air flows about or around a center door panel.

Figure 9:
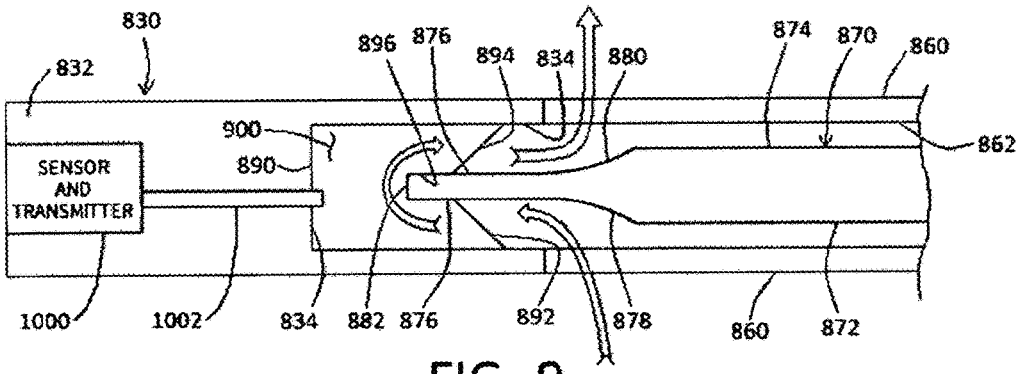
FIG. 9 is a schematic view of a portion of a door 830.
Figure 14:
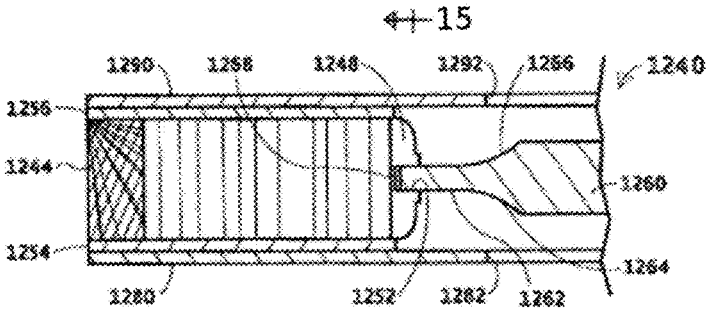
FIG. 14 is a view in partial section of a portion of a door 1240.

FIG. 9, original FIG. 14 in the '980 patent, is a schematic view of a portion of the stile and rail door 830. For the following discussion, reference will be made to FIG. 9 and to the '980 patent.

The door 830 includes a pair of stiles, of which a stile 832 is shown in FIG. 9. The stile 832 includes a recess or slot 834, which slot or recess comprises the hollow portion of the stile. The door 830 also includes a pair of rails, of which a bottom rail 860 is shown in FIG. 9. The rail 860 includes a slot or recess 862, and the slot or recess 862 comprises the hollow portion of the rail.

The door 830 includes a panel 870. The outer portion of the panel 870 includes an inside face 872 and an outside face 874. The outer portion of the panel 870 includes a tongue 876. The tongue 876 has tapered portions 878 and 880 on the inside and outside faces 872 and 874, respectively. The tongue terminates in an end 882.

The panel 870 is held in place by a plurality of spaced apart support elements 890. The support elements 890 extend into the recesses of the stiles and rails. The support elements 890 include inwardly extending sides 892 and 894. The tapering sides terminate in a recess 896. The tongue 876 extends into the recess 896, with the end 882 in the inner ends of the slots 896 in the support elements 980.

A chamber 900 is defined in the hollow stiles and rails. Air flow through the door, into and out of the chamber 900, is shown by the double arrows as flowing into the recess 834 of the stile 832 on the inside face 872 of the panel 870, about the tapered portion 878 of the tongue 876, into the chamber 900, and out of the chamber 900 passed the tapered portion 880 of the tongue 876, and out of the door 830 through the slot 834 on the outside face 874 of the panel 870. The air flow is non-linear, as discussed above and below for the other doors for preventing pressure build up in a room.

A sensor and transmitter 1000 is shown disposed in the stile 832. A sensor probe 1002 extends from the sensor and transmitter into the chamber 900 and senses desired information from the air flowing into and out of the chamber. Details of the sensor and transmitter and probe 1002 are discussed in detail in column 18 of the '980 patent.

Figure 10:
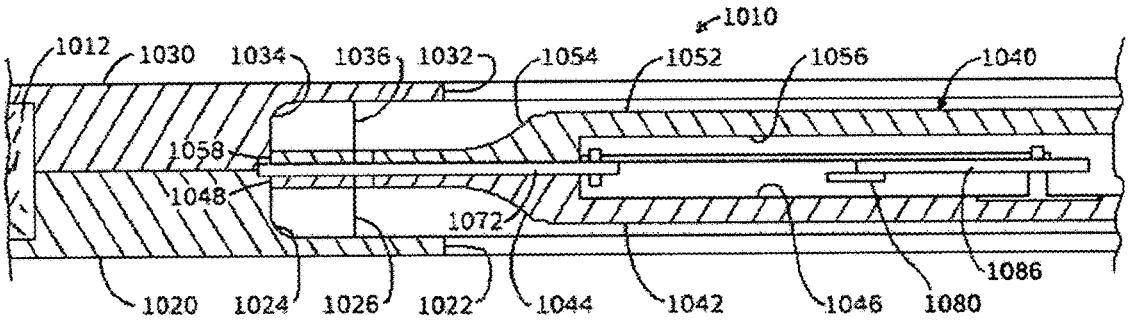
FIG. 10 is a schematic view in partial section of a portion of a door 1010.

The '417 patent discloses a hollow core door 1010 with movable damper panels to control the flow of air through the door. FIG. 10 is a schematic view in partial section of a portion of door 1010, illustrating the structural elements for controlling the flow of air through the door 1010 using movable damper panels disposed in a center panel. The center panel includes two halves, with a hollow interior in which is disposed the damper panels and the structural elements for moving the damper panels. FIG. 10 corresponds to FIG. 21 in the '417 patent. A side damper panel 1072 is show in FIGS. 10 and 11.

Figure 11:
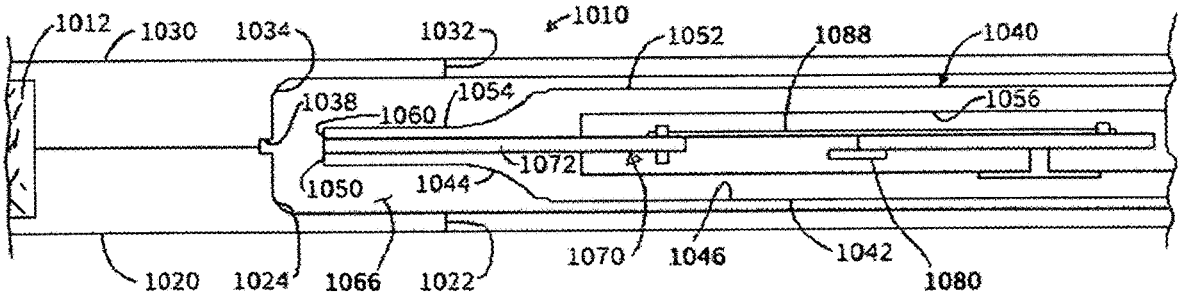
FIG. 11 is a schematic view sequentially following FIG. 10.

FIG. 11 is schematic view sequentially following FIG. 10, but taken at a different location of original FIG. 20A from FIG. 10 and with shows how air may flow through the door 1010. No air flows in FIG. 10 with the damper panel 1072 moved away from inside and outside skins. The hatching shown in FIG. 10 has been omitted from FIG. 12 for clarity. Reference will be made to both FIGS. 10 and 11 for the following discussion.

The door 1010 is a hollow core door having conventional stiles and rails for a frame. A portion of a stile 1012 is shown.

The door 1010 also includes an outside skin 1020 and an inside skin 1030. The skins are secured to the frame and both include peripheral recesses 1024 and 1034, respectively. The skins include openings 1032 and 1034, in the skins 1030 and 1040, respectively. At the juncture of the interior line of the peripheral recesses 1024 and 1034 there is a damper groove 1034. The damper groove is best shown in FIG. 11. In FIG. 10, the tip of a damper panel 1072 extends into the groove 1038 to prevent air flow through the door.

A center panel 1040 is disposed between the skins 1020 and 1030. The center panel 1040 includes two half panels, an outside half panel 1042 and an inside half panel 1052. Each half panel includes a recess. Half panel 1042 has a recess 1046, and the half panel 1052 has a recess 1056. The recesses 1046 and 1056 face each other to define a hollow in which is disposed a damper panel assembly 1070.

The center panel 1040 has a tapered outer perimeter on each half panel. The outside half panel 1042 has a tapered outer perimeter 1044. The inside half panel 1052 has a tapered outer perimeter 1054. The tapered outer perimeters 1044 and 1054 also include tabs 1048 and 1058, respectively, shown in FIG. 10. The tabs are disposed on bosses 1026 and 1036, of the skins 1030 and 1040, respectively. Between the tabs 1048 and 1058 are notches 1050 and 1060, for the half panels 1042 and 1052, respectively. Air flow through the door 1010 is through the notches 1060 and 1050 when the damper 1072 is retracted as shown in FIG. 11.

The damper panel assembly includes a side damper panel 1072 secured by a rod 1088 to a bell crank 1086. As indicated above, the damper 1072 is part of the damper panel assembly 1070. The damper panel assembly includes a bell crank 1086 pivotly secured to the outside half panel 1042. The bell crank is pivotly secured to the damper 1042 by a rod 1088.

The bell crank 1086 is also pivotly secured to an actuator bar 1080. Movement of the bar 1080 pivots the bell crank 1086 which in turn moves rod 1088 to move the panel 1072 into and out of the groove 1038 to either prevent air flow as shown in FIG. 10 or allow air flow as shown in FIG. 11.

The '870 application discloses doors 1200 and 1240 with marginal air flows for controlling the air flow through the doors. Openings in the skins at the margins, or adjacent to where the skins and the stiles and rails are aligned, allow air to flow through the door. Outer skins or baffle panels with outer openings cover the margin openings to provide a non-linear path through the door for sight, sound, and light reduction or limiting purposes.

Figure 12:
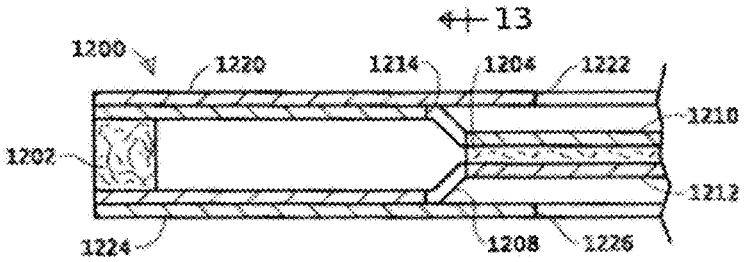
FIG. 12 is a view in partial section of a door 1200.
Figure 13:
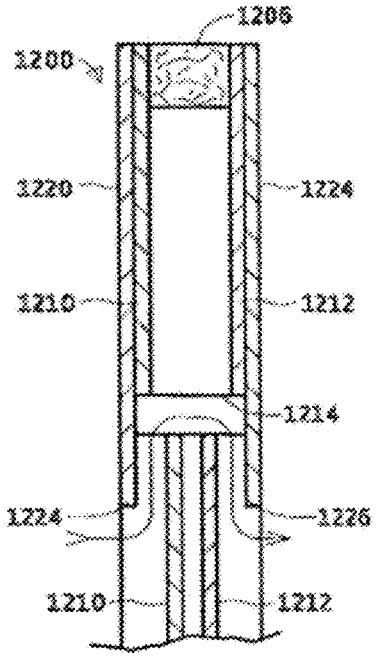
FIG. 13 is a view in partial section of the door 1200 taken generally along line 13-13 of FIG. 12, but perpendicular thereto showing an additional structural element.

FIG. 12 (original FIG. 23) is a fragmentary view in partial section, partially broken away, of a hollow core door embodiment 1200 of the present invention. FIG. 13 (original FIG. 24) is view in partial section, partially broken away, of a portion of the door of the door 1200 taken generally along line 13-13 of FIG. 12, rotated ninety degrees to show an additional structural element, namely a top rail 1206. For the following discussion, reference will be made to FIGS. 12 and 13.

The door 1200 has a conventional hollow core door frame including a pair of stiles, of which a stile 1202 is shown in FIG. 12, a pair of rails, of which a top rail 1206 is shown in FIG. 13. The stiles and rails are appropriately secured together to comprise a conventional stile and rail door frame.

A center element comprising a pair of molded skins is secured to the stile and rail frame. The skins include an inside skin 1210 and an outside skin 1212. Filler material 1204 is shown disposed between the skins 1210 and 1212. The molded skins 1210 and 1212 include inwardly tapered portions 1208, which are well known and understood in the art.

Spaced apart at the margins of the skins and the frame are holes or openings 1214. The holes or openings 1214 extend through the molded skins adjacent to the tapered portions 1208 of the stiles and rails, respectively. The junctures of the skins at or adjacent to the tapered portions 1208 are defined as the margins of the door 1200.

FIG. 12 shows the stile 1202 and the molded inside and outside skins 1210 and 1212, respectively, adjacent to the opening 1214.

On top of the inside skin 1210 is an outer inside skin or cover 1220. The outer inside skin or cover 1220 includes an opening 1222. The opening 1222 is located laterally inwardly from the openings 1214 through the inside and outside skins 1210 and 1212, respectively.

On top of the outside skin 1212 is an outer outside skin 1224. The outer outside skin 1224 includes an opening 1226. The opening 1226 is adjacent to and spaced apart laterally inwardly from the openings 1214. With the openings 1222 and 1226 spaced apart laterally inwardly from the openings 1214, the flow of air through the door 1200 is non-linear.

As shown in FIG. 13 by the elongated arrow, the air flow through the door 1200 is through the opening 1224 in the outer inside skin or cover 1220, along the inside skin 1210, through the opening 1214, along the outside skin 1212, and outwardly through the opening 1226 in the outer outside skin 1224. As may be understood by the curved arrow in FIG. 13, the air flow through the door 1200 is non-linear, with at least five changes of direction. This non-linear air flow pattern is also present in the prior art doors discussed above.

The openings 1224 and 1226 are aligned generally parallel to each other. This alignment is shown clearly in FIGS. 12 and 13.

It will be noted that part of the door 1200 may be prefabricated. The prefabrication allows a degree of efficiency in the manufacturing process that is not otherwise found in the assembly and manufacture of many products.

Figure 15:
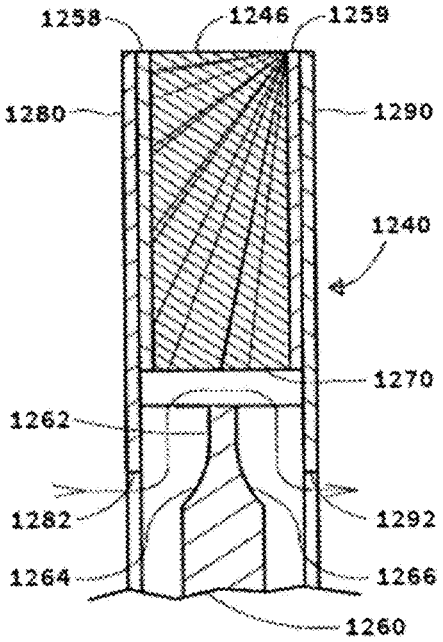
FIG. 15 is a view in partial section taken generally along line 15-15 of FIG. 14, but perpendicular thereto showing an additional structural element.

FIG. 14 (original FIG. 26) is a view in partial section, partially broken away, of a stile and rail door embodiment 1240. FIG. 14 is taken through a stile 1244. FIG. 15 (original FIG. 27) is a view in partial section taken generally along line 15-15 of FIG. 14, rotated ninety degrees to show top rail 1246. For the following discussion, reference may be made to both FIGS. 14 and 15.

The door 1240 includes a conventional stile and rail frame, of which the stile 1244 and the top rail 1246 are shown in FIGS. 14 and 55. The stile 1244 is illustrated as an engineered stile, with a solid wood outer element and a plurality of plywood elements secured to the solid wood element. The purpose of engineered stiles is to reduce warping of the door. The rails are generally solid wood, since warping is not a problem for the rails. The stiles and rails are appropriately secured together to comprise a frame.

Laminates 1254 and 1256 are shown secured to the stile 1244. Laminates 1258 and 1259 are shown secured to the rail 1246. The laminates cover the stiles and the rails for aesthetic purposes.

On the inside perimeter of the stiles and rails of the frame 1242 is a conventional ovolo sticking 1248. The ovolo sticking 1248 is best shown in FIG. 14. There is a groove or slot 1252 centered in the ovolo sticking 1248. The groove or slot 1252 receives the outer perimeter of a center element or panel 1260

The center panel 1260 is secured to the stiles and rails in the groove 1252 at a reduced thickness outer perimeter 1262 of the panel 1260. The reduced thickness outer perimeter 1262 includes a tapered inside portion 1264 and a tapered outside portion 1266. The reduced thickness outer perimeter 1262 terminates in an outer end 1268. The end 1268 and an adjacent part of the reduced thickness outer perimeter 1262 extend into the groove or slot 1252 of the sticking 1248 and is appropriately secured therein.

The ovolo sticking 1248 and the adjacent portion of the reduced thickness outer perimeter 1262 define the margin portion of the door 1240, through which extends a plurality of spaced apart openings 1270.

An inside skin element or cover 1280 is disposed about the stiles and rails of the door 1240. The inside skin element or cover 1280 includes an opening 1282. The opening 1282 is located laterally inwardly relative to the openings 1270 to provide the non-linear flow of air through the door 1240.

An outside skin element or cover 1290 is disposed about the stiles and rails of the door 1240 generally parallel to the inside skin or cover 1280. The outer skin or cover 1290 includes an opening 1292 which is aligned generally parallel to the opening 1282 of the skin or cover 1280.

In the stile and rail door 1240, the inside and outside skin elements 1280 and 1290 are essentially outer inside and outer outside elements, respectively.

The openings 1282 and 1292 are disposed adjacent to and spaced laterally inwardly from the openings 1270 of the door 1240 to provide a non-linear path for the air flow through the door as shown in FIG. 15 by the elongated arrow.

As shown FIG. 15, air flow through the door 1240 flows about the opening 1282 in the skin 1280 and past the tapered portion 1264 of the outer perimeter reduced thickness portion 1262 of the center frame 1260. The air then flows through the openings 1270 and around the reduced thickness portion 1262, past the outside tapered portion 1266. The air then flows outwardly through the opening 1292 of the outside skin or frame 1290. The air flow is in a non-linear manner, as indicated by the arrow in FIG. 15, to help control light, sight, and sound through the door. The non-linear air flow also, as with the previously discussed doors, has at least five changes of direction.

The '347 application discloses a hollow core door 1400 which includes peripheral supports for supporting a center panel about which air flows through the door. The door 1400 may be prefabricated, as will be discussed below.

Figure 16:
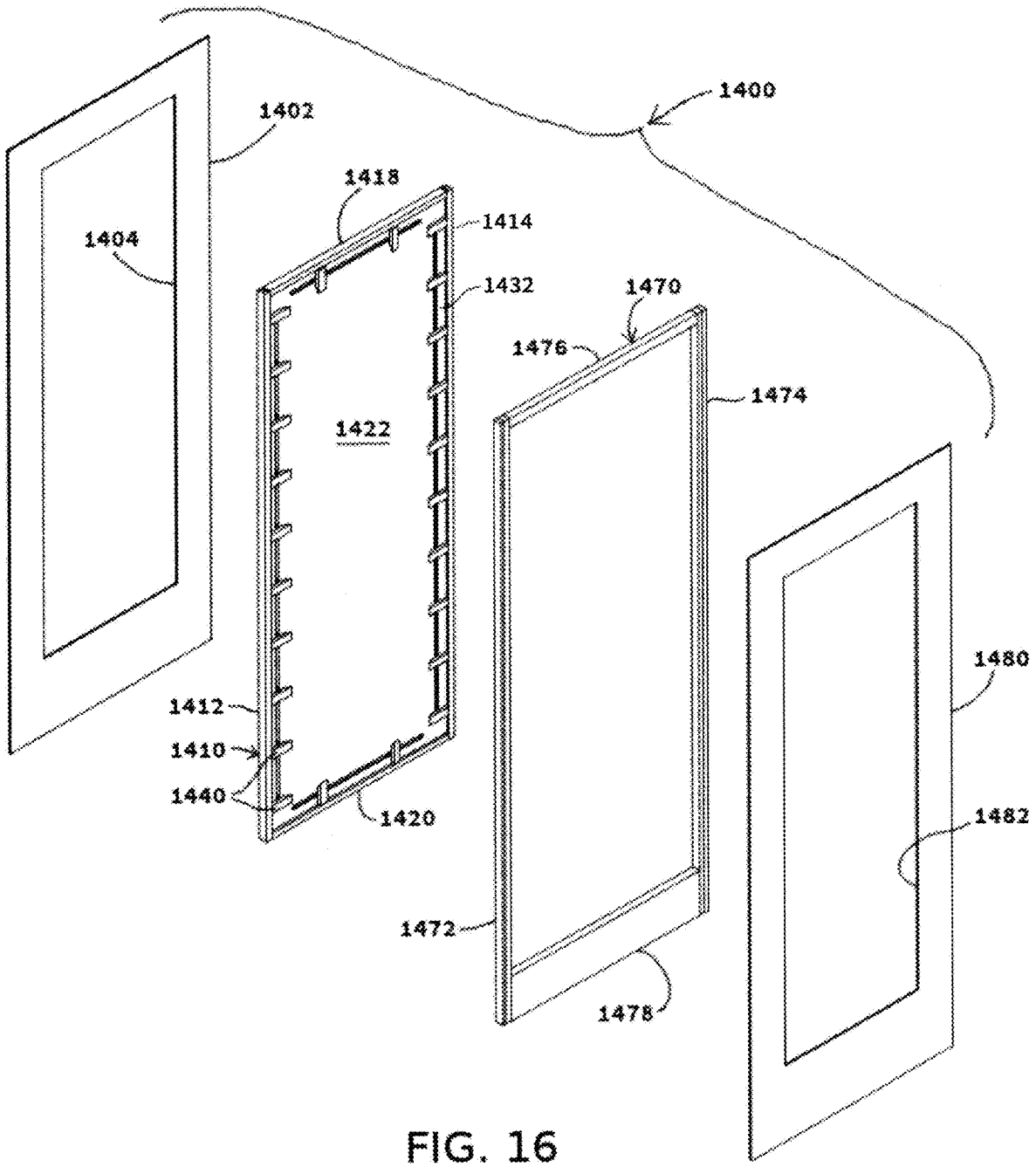
FIG. 16 is an exploded view of a door 1400.

FIG. 16 (original FIG. 26) is an exploded perspective view of the door 1400. The door 1400 includes an inside skin 1402, and the inside skin 1402 includes an opening 1404. Next to the inside skin 1402 is the core assembly 1410. The core assembly 1410 includes a pair of core stiles 1412 and 1414, and a pair of core rails 1418 and 1420. Within the core stiles and rails is a core panel 1422.

The core panel 1422 is the center panel for the door 1400. The outer edges of the core panel 1422 extend into grooves of the core panel frame of stiles 1412 and 1414 and rails 1418 and 1420. Spaced inwardly from the core panel frame are openings 1432 in the core panel 1422. Air flow through the core panel 1422 are through the openings 1432.

The door 1400 includes an outer stile and rail frame 1470 and an outside skin 1480. The outside skin 1480 includes an opening 1482. The openings 1404 and 1482 are generally parallel to each other and are the same size.

Support/spacing elements 1440 are spaced apart about the core panel 1422 for supporting the core panel in the core stile and rail frame.

The adjacent surfaces of the spacer/support elements 1440 and the adjacent surfaces of the core panel frame. The elements 1440 support the core panel 1422 in the core frame, and spaces the core panel 1422 from the adjacent inside and outside skins 1402 and 1480, respectively, to provide for the flow of air through the door 1400.

The outer stile and rail frame 1470 includes a pair of stiles 1472 and 1474, and a pair of rails 1476 and 1478. The stiles and rails are appropriately secured together to define the outer frame 1470 of the door 1400.

Assembly of the door 1400 begins by laying down the inside skin 1402. The outer stile frame 1470 is placed on the inside skin, and the core assembly 1410 is positioned within the frame 1470. Finally, the outside skin 1480 is placed on the outer frame 1470 and the core assembly 1410. Adhesives are preferably used to secure the various elements together, including securing the outer skin 1480 to the outer frame 1470 and the core assembly 1410. An appropriate press may be used to bond the component elements together by curing the adhesives.

The outer frame 1470 is preferably secured together as appropriate before assembly of the door 1400. With the core assembly 1410 also prefabricated, final assembly is relatively efficient and rapid.

The air flow through the door follows the non-linear path through the door as with the previous doors discussed above. The air flow is through the opening 1404 in the inside skin 1402, along the core assembly 1410, through the openings 1432 in the center panel 1422, along the core assembly 1410, and outwardly through the opening 1482 in the outside skin 1480.

As with the other doors discussed herein, appropriate material may be added to the inside of the door 1400 for removing noxious material from the air flow through the door.

Figure 17:
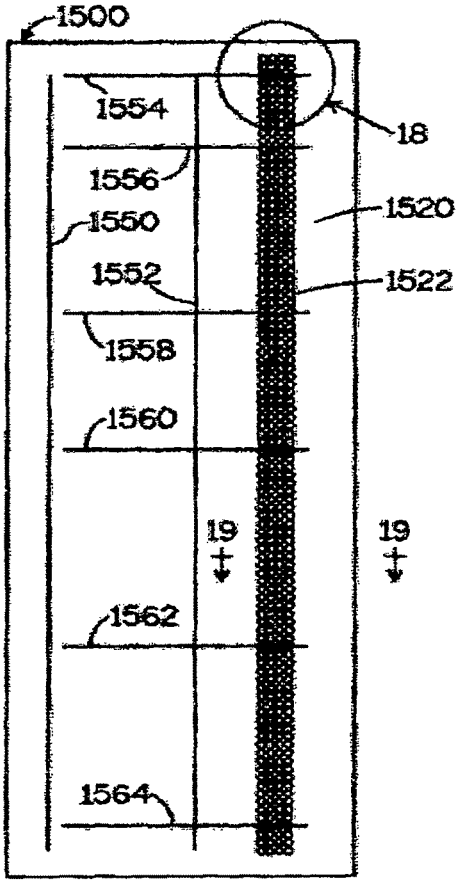
FIG. 17 is a front plan view of a hollow core door 1500 of the present invention.
Figure 18:
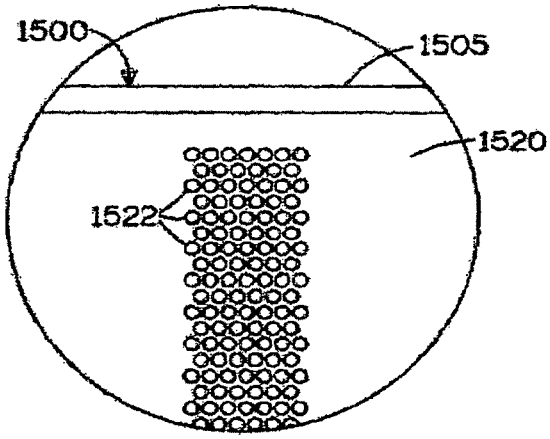
FIG. 18 is a fragmentary view of the door 1500 taken from Circle 18 of FIG. 17.
Figure 19:
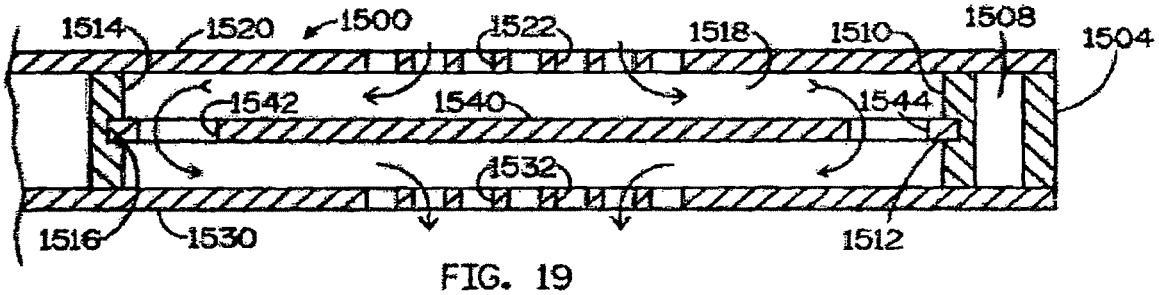
FIG. 19 is a view in partial section taken generally along line 19-19 of FIG. 17.

FIG. 17 is a front view of a door 1500 of the present invention. FIG. 18 is an enlarged view of a portion of the door 1500 taken generally from Circle 18 of FIG. 17. FIG. 19 is an enlarged view of a portion of FIG. 17 taken generally along line 19-19 of FIG. 17. For the following discussion reference may be made to FIGS. 17, 18, and 19.

The door 1500 is a hollow core door with the standard stile and rail frame and an inside skin and an outside skin secured to the frame. A stile 1504 and a bottom rail 1508 are shown in FIG. 19. An inside skin 1520 is shown in FIGS. 17, 18 and 19, and an outside skin 1530 is shown in FIG. 19.

A plurality of apertures or holes 1522 extend in rows and columns through the inside skin 1520. In FIG. 18, the rows and columns are shown in some detail. The holes or apertures are shown in FIG. 17 as being adjacent to one side of the door 1500, it will be noted that they may be located as desired. The number and size of the holes or apertures, and their configuration, may be as desired and as appropriate for convenience and esthetic purposes.

The size and number of the holes is correlated with the air flow such that the air flow into and out of a room will prevent pressure build up. Thus, for a relatively small room, the number of holes may be less than is required for a larger room. In other words, the size and number of the holes may vary according to the size of the room to which a particular door is secured.

Both the inside and outside skins have aligned rows and columns of the holes. This is shown in FIG. 19.

Spaced apart between the inside and outside skins is a panel 1540. The panel is wider and longer than the rows and columns of the holes or apertures 1522, and thus has an area greater than the area of the holes, which causes the air flow through the inside skin to divide, as shown by the arrows in FIG. 19. The panel 1540 is preferably centered between the rows and columns, thus balancing the divided air flow through the door 1500.

Spaced apart from the stile 1504 is a vertical support element 1510. The element 1510 has a slot 1512 into which the outer side of the panel 1540 extends. At the opposite end of the panel 1540 from the support element 1510 is a parallel support element 1514. A groove 1516 in the element 1514 receives the inner side of the panel 1540. A bottom frame element 1518 is secured to the side supports or frame elements 1510 and 1514. A top frame element is not shown. The top and bottom frame elements may be the top and bottom rails.

An opening 1542 extends vertically spaced apart a relatively short distance from the support element 1514. A similar opening 1544 extends through the panel 1540 spaced apart a relatively short distance from the support element 1510. The air flow about the panel 1540 is through the openings 1542 and 1544.

Generally parallel to the holes 1522 in the inside skin 1520 are rows and columns of holes 1532 which extend through the outside skin 1530. The holes 1522 and 1532 are generally parallel to each other. The air flow through the holes 1522 divides outwardly as it flows along the inside of the panel 1540 and through the openings 1542 and 1544 in the panel 1540 to flow along the outside of the panel 1540 to flow outwardly through the holes or apertures 1532 in the outside skin 1530. As shown by the arrows in FIG. 19, the air flow through the door 1500 changes direction a least five times in its non-linear flow.

The openings 1542 and 1544 are spaced outwardly from the rows and columns of holes 1522 and 1532, and adjacent to the support elements 1514 and 1510, respectively. Accordingly, the air flow through the skins 1520 and 1530 and divides as it flows outwardly and then through the openings 1542 and 1544 in the panel 1540. The openings 1542 and 1544 represent pluralities of spaced apart openings extending vertically along the sides of the panel 1540 through which air flows through the panel 1540. The vertical alignment of the openings 1542 and 1544 is shown in FIG. 24, corresponding to the openings 1642 and 1644 for the panel 1640.

The elements 1508, 1510, 1514, and a top frame elements, not shown, define a frame for supporting the panel 1540 within the door 1500. The panel 1540 and its frame elements thus comprise a component assembly which may be prefabricated and inserted as a component prior to the securing of the inside skin 1520 to the stile and rail frame of the door. It will be noted that the order of assembling the skins to the door frame is immaterial. The frame for the panel 1540 will be inserted "on top" of which ever skin is first secured to the door frame, and the "other" skin will then be secured to the door frame.

In other words, the assembly of the door 1500 includes the steps of punching or drilling holes in the inside an outside skins and securing a skin to the stile and rail frame. Next, the panel 1540 with its frame members is placed on the skin and the other skin is then placed on the stile and rail frame. The elements are appropriately bonded together to define the door 1500.

As indicated above, the location and size of the holes may vary according to the size of the room in which a particular door is installed. Moreover, the configuration of each hole may also vary as desired. The holes are shown as round, but they need not be limited to round. Aesthetics or personal preferences may dictate the configuration of the holes and also the placement of the holes on a door.

The important feature is simply the total area of the holes must provide for the air flow required to prevent the build up of pressure in a room. The location or orientation of the holes may be as desired. For example, lines 1550, 1552, 1554, 1556, 1558, 1560, 1562, and 1564 schematically illustrate various locations for the placement of the holes. The holes 1522 are along one side of the door 1500 generally adjacent to a stile, and the holes represented by the line 1550 are along the opposite side of the door 1500. The holes represented by the line 1552 are centered vertically on the door 1500.

The lines 1554, 1556, 1558, 1560, 1562, and 1564 schematically represent holes placed horizontally either in rows and columns, as desired, anywhere from the top or upper portion of the door 1500, and spaced apart as desired, to the bottom or lower portion of the door 1500. Again, the hole placement or alignment or pattern is immaterial, but the area of the holes must provide for the required air flow through the door to prevent the pressure build up in the room in which the door is installed. In other words, the same air flow out of the room through a door must be equal to or greater than the air flow into the room, to prevent pressure build up. This has been adequately discussed above.

The limiting factor with respect to the holes in the skins is simply that the panel between the skins must cover a greater area than the pattern of the holes and that the openings in the panel correlate in area with the total area of the holes in order to provide the divided air flow in a non-linear manner for sight, sound, and light purposes.

It will be noted that the hole placement illustrated and discussed is shown in generally straight line orientation. It is obvious that the hole placement may be in any configuration, serpentine, oval, or any desired orientation or pattern. The limiting factor is simply that the pattern of holes must provide the required air flow relative to the air flow into the room as discussed above. With a divided air flow as illustrated and discussed, a panel centered with respect to the hole design or pattern must be wider than the hole design or configuration such that the air flow through the inside holes is divided and flows along the center panel, through the openings in the centered panel, along the center panel again, and outwardly through the outside holes non-linearly.

Figure 20:
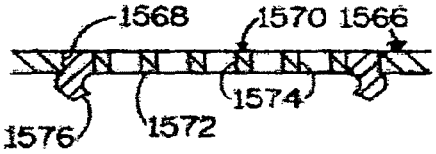
FIG. 20 is a schematic view in partial section of an alternate embodiment element of the door of FIG. 17.

FIG. 20 is schematic representation in partial section of a portion of a skin and an inert into an opening in the skin. The insert includes any desired hole pattern, as discussed above. Thus, rather than making the desired hope pattern in the skins, the insert simply is placed in an opening in a skin. The insert is a prefabricated element that snaps into an opening in a skin. Obviously, inserts will be added to both inside and outside skins in parallel alignment.

A portion of a skin 1566 is shown, with an opening 1568 extending through the skin. A hole insert 1570 is disposed in the opening 1568. The hole insert 1570 includes a panel 1572 through which extend a plurality of holes 1574. The boles 1574 may be in any desired pattern, as indicated above.

The hole insert 1570 is secured in the opening 1568 by a peripheral or edge snap element 1576. The element 1576 performs two functions, it serves to secure the insert 1570 to the skin 1566 and it seals the insert 1570 in the opening 1568 of the skin 1566.

Figure 21:
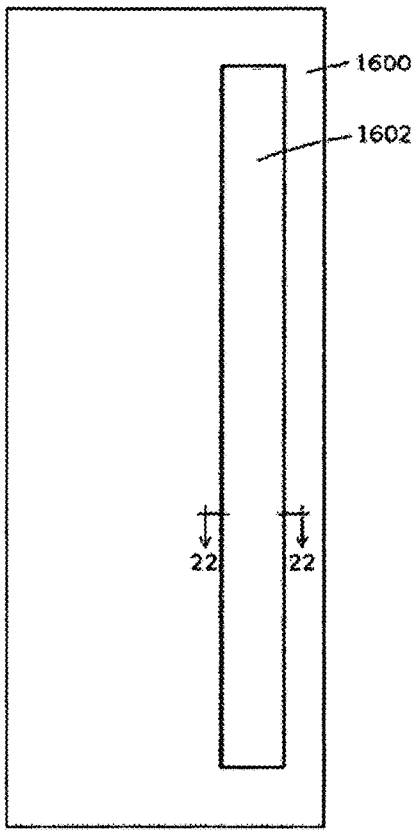
FIG. 21 is a rear plan view of a modified skin of a hollow core door having a divided air flow.

FIG. 21 is a rear plan view of a skin 1600 with a backing plate 1602 secured to the rear of a skin. The backing plate 1602 may be metal, such as aluminum or a stiff composite, plastic material or other appropriate material, to provide a solid element for the holes to be drilled or punched through the skins. Typically the skin is made of mdf and without a backing plate holes may be frayed or incomplete due to the inherent characteristics of mdf. The backing plate insures the integrity of the holes. Moreover, metal or plastic or other appropriate backing plate material, and also center panel material, prevents moisture retention that would promote mold growth within the air flow cavity. Moisture resistant material with in the air flow cavity is thus important.

Figure 22:
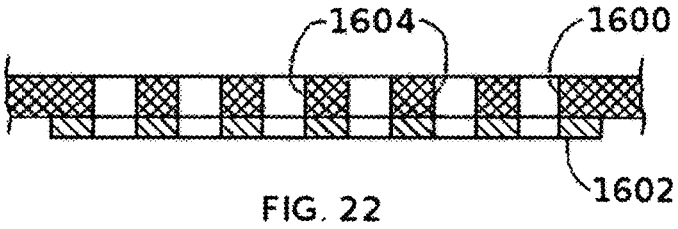
FIG. 22 is a view in partial section taken generally along line 22-22 of FIG. 21.

FIG. 22 is a view of the skin 1600 of FIG. 21 taken generally along line 22-22 of FIG. 21. Holes 1604 extend through the skin 1600 and through the backing plate 1602. The holes 1604, regardless of how they are made, will be generally uniform and without frayed edges or other imperfections which may occur with mdf and without a backing plate.

Figure 23:
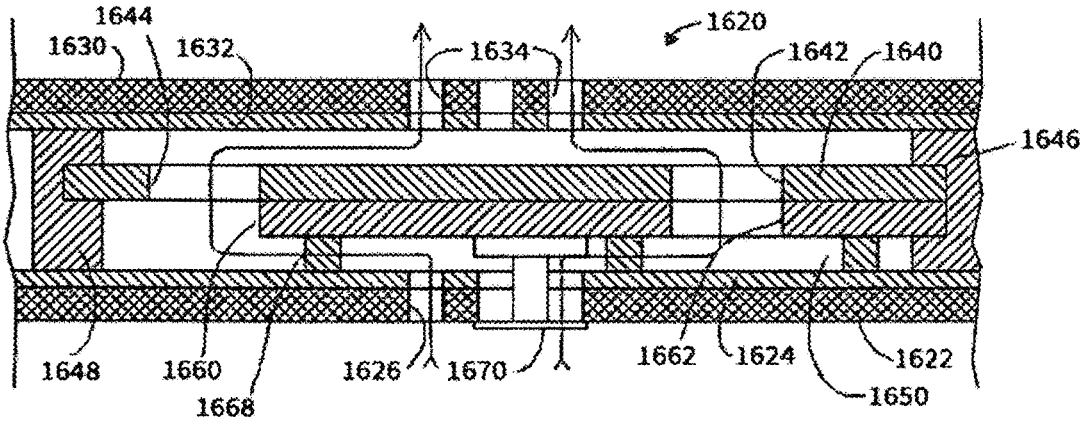
FIG. 23 is an enlarged schematic view in partial section of a door 1500.

FIG. 23 is a schematic representation in partial section of a portion of a door 1620 comprising an alternate embodiment of a divided air flow door. The door 1620 includes privacy elements by having a slider movable to cover and uncover the openings in a centered panel disposed between the holes in the skins.

The door 1620 includes an inside skin 1622 with a backing plate 1624 and a plurality holes 1626 extending through the skin and backing plate. The door 1620 also includes an outside skin 1630. The skin 1630 includes a backing plate 1632 and a plurality of holes 1634 extend through the skin and backing plate.

A centered panel 1640, hereinafter "center panel," includes openings 1642 and 1644. The center panel 1640 is held within a frame which includes side frame elements or members 1646 and 1648 and a bottom frame element or member 1650. The frame also includes a top frame element or member, not shown.

Disposed against the center panel 1640 is a slider panel 1660. The slider panel 1660 includes an opening 1662. The slider panel 1660 is supported by slide supports 1668.

The slider panel 1660 slides laterally as desired to uncover the openings 1642 and 1644 to allow air to flow through the openings as shown by the arrows, from the onside holes 1626 and through the outside holes 1634. When the slider panel 1660 is moved by a slider lock assembly 1670 secured to the slider panel 1660 to cover the openings 1642 and 1644, no air flows.

The movement of the slider panel 1660 is schematically illustrated in FIGS. 24, 25, 26, and 27. FIG. 24 is a fragmentary front view of a portion of the center panel 1640, showing openings 1642 and 1644. The openings 1642 and 1644 are illustrated as aligned in vertical rows in the center panel 1640.

FIG. 25 is a fragmentary front view of a portion of the slider panel 1660, showing a plurality of openings 1662. The openings 1662 are substantially identical to the openings 1642, and are similarly aligned vertically. The slider panel 1660 includes an "outside" edge 1664, and an "inside" edge 1666. The portion of the slider panel 1660 between the openings 1662 and the outside edge 1664 covers the openings 1642 when the slider panel 1660 is moved laterally. At the same time, the portion of the slider panel 1660 inwardly from the inside edge 1666 covers the openings 1644 in the panel 1640. Accordingly, no air flows through the panel 1640 and thus through the door 1620.

Figure 26:
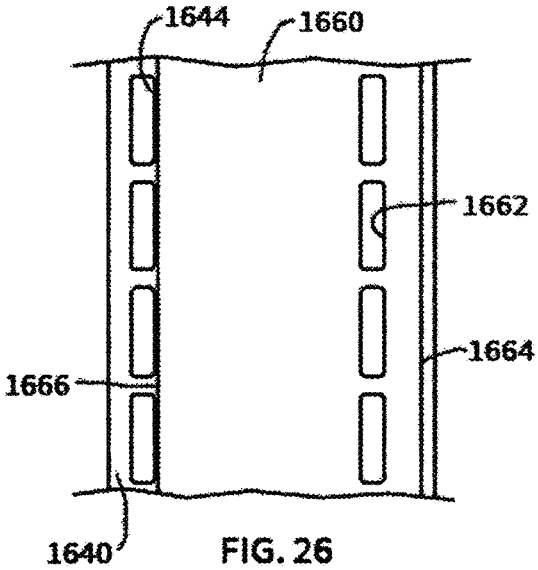
FIGS. 26 and 27 are sequential fragmentary views illustrating the movement of the elements of FIGS. 24 and 25.

FIG. 26 illustrate the "open" or air flow alignment of the slider panel 1660 as shown in FIG. 23. When the slider panel 1660 is disposed against the center panel 1640, as shown in FIG. 23, the openings 1642 and 1662 are aligned for air flow through the openings 1642 and 1644, in the center panel 1640.

Figure 27:
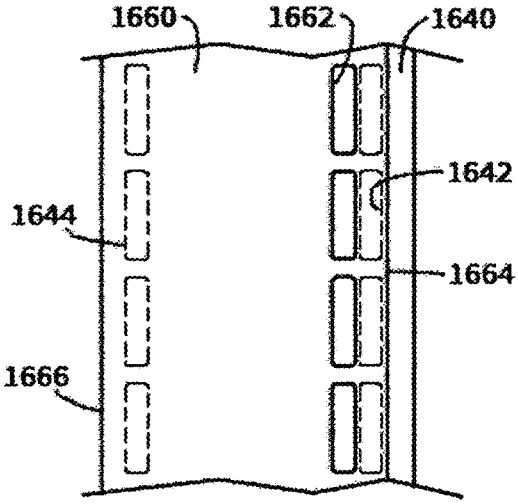

FIG. 27 sequentially follows FIG. 26. When the slider lock assembly 1670 is turned or moved (see FIG. 23) the slider panel 1660 moves laterally to block air flow through the center panel 1640. The openings 1642 are blocked by moving the openings 1662 out of alignment with the openings 1642. The openings 1644 are also blocked by the slider panel 1660, and thus no air flows through the center panel 1640. The portion of the slider panel 1660 between the between the "outside" edge 1664 covers the openings 1642. The portion of the slider panel 1660 adjacent to the "inside" edge 1666 covers the openings 1644. The slider panel and its elements are also preferably made of moisture resistant material, as stated above, to maintain the desired anti-mold characteristics of the air flow cavity.

The slider panel 1660 thus provides privacy as desired, and for a bathroom door, a bedroom door, a laundry door, or wherever the choice between air flow through the door and no air flow through the door is desired. The primary concern with respect to a slider panel is sound passage through a door.

While manual actuation of the slider panel is shown and discussed, the use of automatic actuation by computer control or switch controlled electric motors, or otherwise, for example, as discussed above for the doors 650, 830, and 1010, may also be employed.

Figure 28:
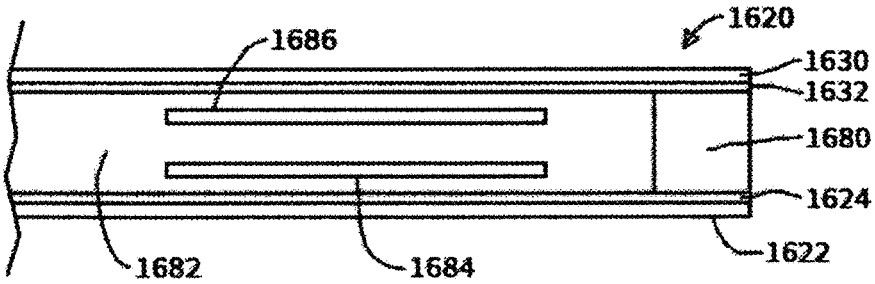
FIG. 28 is a top view of a hollow core door illustrating openings for masking the interior of a door prior to painting the door.

FIG. 28 is a view looking downwardly at a top rail 1682 of the door 1620, showing a pair of paint masking openings or slots 1684 and 1686. The door 1620 includes a stile 1680 and the top rail 1682. The inside skin 1622 and its backing plate 1624, and the outside skin 1630 and its backing plate 1632 are also shown.

The purpose of the paint masking slots 1684 and 1686 is to provide openings though which paper or other appropriate masking material may be temporarily inserted to protect the interior of the door, and especially, but not necessarily, slider elements, from paint as the door 1620 is initially painted. The masking material may placed during the assembly of the door. After painting, the masking material may be easily removed.

Figure 29:
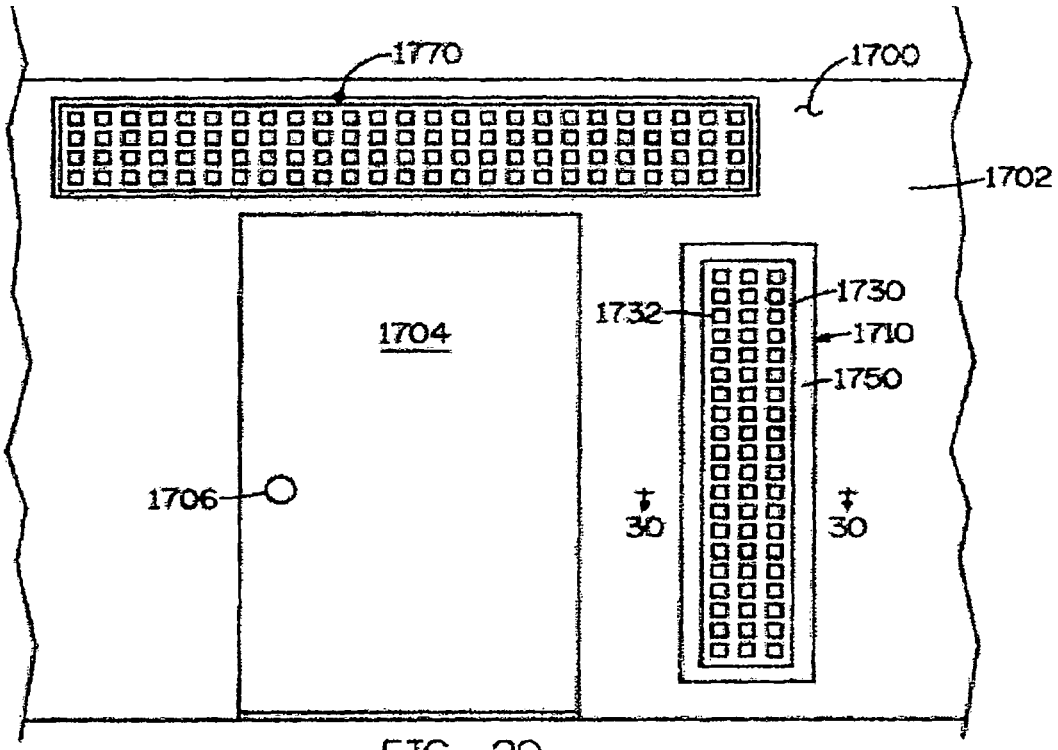
FIG. 29 is a front plan view of a room in which is disposed an alternate embodiment of the present invention.
Figure 30:
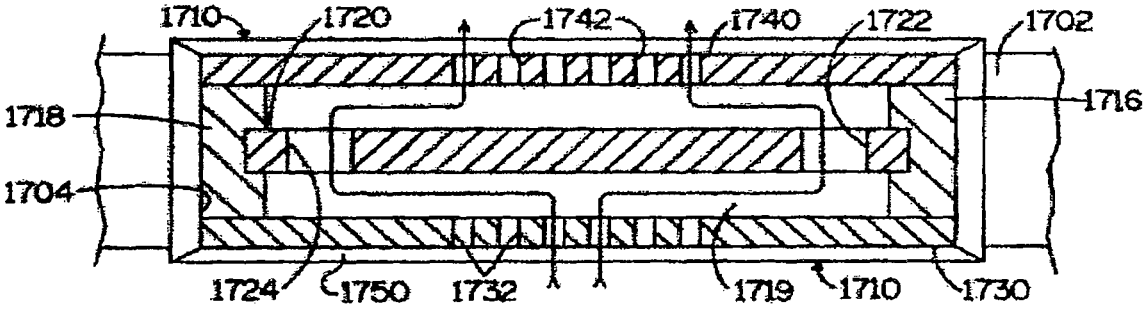
FIG. 30 is a schematic view in partial section taken generally along line 30-30 of FIG. 29.

The nature of the holes and panel between the holes for a divided air flow adapts itself readily to packaging the elements for use in a transom above a door or insertion in a wall. FIG. 29 is a schematic representation of a room with a divided air flow assembly inserted in a wall. FIG. 30 is a schematic representation of the door of FIG. 29 taken generally along line 30-30 of FIG. 29. For the following discussion, reference may be made to both FIGS. 20 and 30.

A portion of a room 1700 is shown in FIG. 29. The room 1700 includes a wall 1702, and a door 1704 is in the wall 1702. The door 1704 has a door knob 1706. Adjacent to the door 1704 is a divided air flow assembly 1710. The purpose of the divided air flow assembly is substantially the same as the doors 1500, 1600, and 1620. The assembly 1710 is appropriately dimensioned to fit between wall studs (not shown) in a typical wall in a home.

The divided air flow assembly 1710 includes a frame including vertical frame members 1716 and 1718, and a bottom frame member 1719. The frame also includes a top frame member, not shown. A panel 1720 is appropriately secured to the vertical frame members 1716 and 1718 substantially as shown in FIG. 19 for the corresponding elements. Extending through the panel 1720 are spaced apart openings 1722 and 1724.

Secured to the frame members 1716 and 1718 are an inside skin or panel 1730 and an outside skin or panel 1740. For convenience, the skins or panels will be hereinafter referred to simply as "skins." A plurality of holes 1732 extend through the inside skin 1730 and a plurality of holes 1742 extend through the outside skin 1740. The panel 1720 is preferably centered between the skins 1730 and 1740, as with the other divided air flow structure discussed above.

The pluralities of holes 1732 and 1742 correspond to the pluralities of holes extending through the skins of the doors 1500, 1600, and 1620, discussed above. The openings 1722 and 1724 correspond to the openings 1542 and 1544, and 1642 and 1644 for the divided air flow structures discussed above, and being in spaced apart and aligned columns as shown in FIG. 24.

The openings 1722 and 1724 are spaced apart outwardly from the holes 1732 and 1742, thus causing air flow through the holes 1732 to divide and flow outwardly along the panel 1720, through the openings 1722 and 1724 and again along the panel 1720 and outwardly through the wall 1702 through the holes 1742 in the outside skin 1740 in a non-linear manner as shown by the long arrows in FIG. 30.

A molding 1750 is disposed about the periphery of the skins 1730 and 1740 and the frame members 1716 and 1718 for decorative purposes.

As with the previously discussed divided air flow doors, the size, number, and orientation of the holes is immaterial. The important feature of the divided air flow concept is that the air flowing through the holes in the skins and through the openings in a panel between the skins must provide the required quantitative flow of air to prevent the build up of pressure in the rooms in which the doors or assemblies are located. As stated above, the recommended maximum air pressure in a closed room is three pascals.

Figure 31:
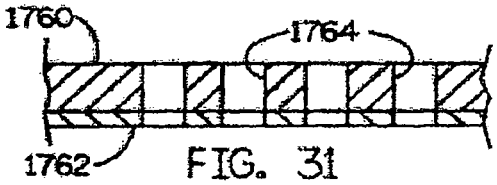
FIG. 31 is a view in partial section of a portion of a skin with a backing plate.

It will be noted that the "skins" of the assembly 1710 preferably include backing plates. FIG. 31 is a view on partial section of a portion of a skin 1760 with a backing plate 1762 secured to the skin. A plurality of holes 1764 extend through the skin and backing plate.

Also shown in FIG. 29 above the door 1704 is a horizontally disposed divided air flow assembly 1770. The structure of the assembly 1770 is substantially the same as the assembly 1710. The difference is simply the orientation of the two assemblies. For the horizontal orientation, horizontal frame members holding a panel obviously correspond to the vertical or side frame members of the vertically oriented assemblies.

The assembly 1710 is designed to fit between wall studs. The assembly 1760 may require structural changes in a wall whether such an assembly is located above a door or in any horizontal location along a wall. Regardless, the discussion above for the air flow applies.

In practice, an opening is first cut into a wall, and the assembly is prefabricated and inserted into a wall opening and secured therein. The molding is then applied to the wall and to the frame and skins structure to complete the assembly.

It will be understood that scrubber material may be added to the divided air flow structures as desired, as discussed above.

While the principles of the invention have been made clear in illustrative embodiments, there will be immediately obvious to those skilled in the art many modifications of structure, arrangement, proportions, the elements, materials, and components and methods used in the practice of the invention, and otherwise, which are particularly adapted to specific environments and operative requirements, without departing from those principles. For examples, the perforation or openings in the skins may be random rather than in rows, and the perforations may be located in the skins at any desired location. Moreover, an obvious alternative to securing the centered panel in the manner shown, would be to secure the centered panel at its top and bottom and the air flow would be around the panel rather than through openings adjacent to the outer or side edges as shown. The appended claims are intended to cover and embrace any and all such modifications, within the limits only of the true spirit and scope of the invention.

What I claim is:

1. A hollow core door having a divided air flow through the door for preventing pressure build up in a closed room with a forced air flow comprising in combination:
   - a stile and rail frame;
   - an inside skin secured to the stile and rail frame;
   - a plurality of inside holes extending through the inside skin and having a predetermined area;
   - an outside skin secured to the stile and rail frame;
   - a plurality of outside holes extending through the outside skin and generally aligned with the plurality of inside holes in the inside skin and having a predetermined area substantially the same as the predetermined area of the plurality of inside holes;
   - a panel disposed within the hollow core door spaced apart from and between the pluralities of inside and outside holes, the panel having an area greater than the area of the plurality of inside holes, and having openings disposed laterally of the pluralities of inside and outside holes; whereby
   - air flows inwardly through the plurality of inside holes, divides and flows along an inner side of the panel, through the panel openings, along an outer side of the panel, and then flows outwardly through the plurality of outside holes in a non-linear manner to prevent the pressure build up in the room.

2. The door of claim 1 which includes a panel frame including a pair of vertical panel frame elements for supporting the panel between the inside and outside skins at the pluralities of inside and outside holes.

3. The door of claim 2 in which the panel is disposed between and secured to the pair of vertical panel frame elements.

4. The door of claim 3 in which the panel openings are adjacent to the pair of vertical panel frame elements.

5. The door of claim 1 in which the pluralities of inside and outside holes are disposed adjacent to a stile of the stile and rail frame.

6. The door of claim 1 in which the pluralities of inside and outside holes are spaced apart from stiles of the stile and rail frame door.

7. The door of claim 1 in which the inside and outside skins each include an opening, the openings are configured to receive an insert panel.

8. The door of claim 7 in which a plurality of holes are disposed in the insert panel.

9. The door of claim 8 in which the openings in the inside and outside skins for receiving the insert panels are generally parallel.

10. The door of claim 1 which further includes a backing plate secured to the inside skin and a backing plate secured to the outside skin, each backing plate having a plurality of holes extending therethrough, such that the plurality of backing plate holes and the pluralities of holes extend through the inside and outside skins and through their respective backing plates.

11. The door of claim 3 in which the openings in the panel comprise a first plurality of openings aligned vertically adjacent to a first of the pair of the vertical panel frame elements and a second plurality of openings aligned vertically adjacent to a second of the pair of the vertical panel frame elements.

12. The door of claim 11 which further includes a slider panel disposed adjacent to the panel, and the slider panel includes a plurality of openings aligned with and overlying the first pluralities of openings in the panel when the slider panel is in a first position.

13. The door of claim 12 in which the slider panel has a first lateral edge and a second lateral edge, the plurality of openings in the slider panel is adjacent to and spaced apart from the first lateral edge, the plurality of openings in the slider panel is aligned with and overlying the first plurality of openings in the panel when the slider panel is in the first position, to allow a flow of air through the aligned openings in the panel and the slider panel.

14. The door of claim 13 in which the slider panel second lateral edge is spaced apart from and adjacent to the second plurality of openings in the panel when the slider panel is in the first position.

15. The door of claim 14 in which the slider panel includes a slider lock assembly for moving the slider panel laterally with respect to the panel, the panel movable into the first position and alternately into a second position, whereby when the slider panel is in the second position, a first portion of the slider panel proximal the first lateral edge covers the first plurality of openings in the panel and a second portion of the slider panel proximal the second lateral edge covers the second plurality of openings in the panel;

the plurality of openings in the slider panel located between the first and second portions of the slider, such that when the slider lock assembly actuates the slider panel into the second position, the flow of air through the panel is prevented, and such that when the slider lock assembly actuates the slider panel into the first position, the plurality of openings in the slider panel are moved into alignment with the first plurality of openings in the panel and away from the second plurality of openings in the panel to allow the flow of air through the first and second pluralities of openings in the panel.

16. The door of claim 1 in which the stile and rail frame includes a top rail, and the top rail includes a pair of slits for receiving appropriate masking material, such as paper, for masking the panel to protect the panel from paint.

17. The door of claim 1 which further includes a coating on an inside surface of a skin of the door for scrubbing noxious material from the flow of air through the door.

* * * * *